US007231937B2

(12) United States Patent
Greene et al.

(10) Patent No.: US 7,231,937 B2
(45) Date of Patent: Jun. 19, 2007

(54) AUTOMATIC SHUTOFF VALVE

(76) Inventors: Ralph G. Greene, 3600 Lee Pike, Soddy Daisy, TN (US) 37379; Nelson Edwards, 2022 N. Concord Rd., Chattanooga, TN (US) 37421

( * ) Notice: Subject to any disclaimer, the term of this patent is extended or adjusted under 35 U.S.C. 154(b) by 163 days.

(21) Appl. No.: 10/855,074

(22) Filed: May 27, 2004

(65) Prior Publication Data

US 2007/0113900 A1 May 24, 2007

Related U.S. Application Data

(60) Provisional application No. 60/473,567, filed on May 27, 2003, provisional application No. 60/511,589, filed on Oct. 15, 2003.

(51) Int. Cl.
*F16K 17/32* (2006.01)

(52) U.S. Cl. ..... 137/462; 137/498

(58) Field of Classification Search ..... 137/460, 137/462 I, 498 X

See application file for complete search history.

(56) References Cited

U.S. PATENT DOCUMENTS 2,346,223 A 4/1944 Lyon et al.
4,471,803 A * 9/1984 Ollivier ..... 137/462
4,522,229 A 6/1985 Van de Moortele
4,535,797 A 8/1985 Rosaen
4,732,190 A * 3/1988 Polselli ..... 137/460
4,736,889 A * 4/1988 Stephenson ..... 239/204
5,261,442 A 11/1993 Kingsford et al.
5,967,173 A 10/1999 Kingsford et al.
6,202,683 B1 * 3/2001 Smith ..... 137/498

OTHER PUBLICATIONS

MPR Engineering Services, Advanced Control Technology for Ruptures and Leaks using Smart Valves, Publications/Issue #7, 3 pages, printed from Internet site http://www.mpr.com/.

* cited by examiner

*Primary Examiner*—Stephen M. Hepperle
(74) *Attorney, Agent, or Firm*—Stephen J. Stark; Miller & Martin PLLC

(57) ABSTRACT

An automatic shutoff valve is provided. The valve is preferably constructed of a check valve (which is normally shut) and a shutoff valve which is open during static, no-flow, operation. Upon initiation of flow, even a drip flow, the check valve opens, and the pressure differential from the inlet to the outlet causes a piston in the shutoff valve to move toward a shut position. As long as the pressure differential stops before the piston closes, the shutoff valve resets to the fully open position. However, if the shutoff valve shuts, it preferably must be manually reset.

19 Claims, 4 Drawing Sheets

AUTOMATIC SHUTOFF VALVE

CLAIM OF PRIORITY

This application claims the benefit of U.S. Provisional Patent Application Nos. 60/473,567 filed May 27, 2003 and 60/511,589 filed Oct. 15, 2003, both of which are incorporated herein by reference.

FIELD OF THE INVENTION

The present invention relates to a shutoff valve for use with liquid systems which utilize no more than predetermined amount of liquid per cycle, and more specifically to an automatic shutoff valve for use in conjunction with appliances and/or fixtures to provide a safety shutoff mechanism in the event of a drop in water pressure downstream of the valve after dispensing up to a predetermined amount of liquid before pressure equalizes across the valve.

BRIEF DESCRIPTION OF RELATED ART

Over the years, several attempts have been made to provide automatic shutoff valves. MPR Associates, Inc. has developed valves and control systems for the U.S. Navy to respond to ruptures and leaks in piping systems. Apparently each of the valves has an embedded microprocessor, network transceiver and pressure sensors in the inlet and outlet of the valve. With the use of microprocessors, sensors, transceivers, and actuators, it is not surprising that a an automatic shutoff valve could be constructed. While this level of complexity may be warranted in some applications, such as a shipboard environment where a steam line rupture could kill all personnel in a particular space if not immediately isolated, a need exists for a simple, and affordable alternative. Even with this level of complexity, it is probable that this type valve cannot detect drip leaks across the valve. Furthermore, in most US Navy shipboard applications, there are many small leaks in a steam system, especially across valve packings. Having an automatic shutoff valve shut during normal operation of the system would not be advantageous.

Many appliances and fixtures are designed to operate on no more than a predetermined amount of liquid passing through a particular pipe upon the performance of a particular action. For instance, when a toilet is flushed, after the water in the tank empties, the water supply refills the tank to a relatively accurate degree to a predetermined amount. When an automatic coffee maker makes a pot of coffee, normally a predetermined amount of water passes through the coffee maker. When an ice maker in a freezer makes ice, normally up to a predetermined amount of water is dispensed at a time. Washing machines and dishwashers also normally utilize up to a predetermined amount of water in a given cycle. As another example, when water is refilled in a UV water cooler, normally the water which refills the tank is less than a predetermined amount. There are many other appliances, fixtures, etc. which operate on a similar cyclic type operation. At any given use of the device, less than a predetermined amount of water is provided or refills the device.

Leaks and ruptures can cause problems. A drip leak in a building can cause rot of wooden floors. Stains can form. Undesirable mold can grow. Carpet and other materials can mildew. Ruptures could result in significant amounts of property damage, especially if no one detects the leak for a significant amount of time. Flooding situations could be caused by stuck open, faulty or leaking appliances, leaks of all types, and damaged water pipes.

Presently, there are no known commercially available valves which provide an automatic shutoff when a drip leak occurs in an appliance or fixture in a business or residential environment.

Several attempts have been made to provide automatic shutoff valves. U.S. Pat. No. 2,346,223 shows a self-closing valve for single directional fluid flow. This valve is capable of preventing back flow through the valve, like a check valve, and can shut in the event of a downstream rupture. However, this valve design is not capable of detecting drip leaks and shutting upon detection of a drip leak, or for shutting if more than a predetermined amount of fluid passes through the valve.

U.S. Pat. No. 4,552,229 shows a rather ingenious valve design which purports to offer automatic shutting on detection of a leak. However, this complicated structure relies on pre-control diaphragm 26 having a lowest resistance to close opening 27 upon detection of a leak. However, if regulator 36 is open, at all, it appears low flow drip leaks may not be detected since the pressures on the top and bottom of the pre-control diaphragm can equalize through the regulator 36. In the absence of the regulator 36 being open, it further appears that in low flow drip leaks that pressure could also equalize across the pre-control diaphragm through openings 8,10, and 27.

U.S. Pat. No. 4,535,797 provides another automatic shutoff valve having a main inlet, a main outlet, a user inlet and a user outlet. A compression spring urges the valve assembly toward its closed position while a fluid flow rate greater than a predetermined amount into the user inlet retains the valve assembly in its open position. The spring is believed to provide the necessary energy to close the valve assembly from the main inlet to outlet in event the fluid flow is interrupted through the user inlet and user outlet.

U.S. Pat. Nos. 5,261,442 and 5,967,173 relate to diaphragm valves with leak detection. These valve have leak detection ports in the event of a leak past the diaphragms in the valves, but are not believed to automatically detect leaks past the outlet of the valves.

Accordingly, a need exists for an improved automatic shutoff valve.

SUMMARY OF THE INVENTION

There exists a need for an improved automatic shutoff valve.

There exists a need for a mechanically activated automatic shutoff valve that does not require electricity to communicate with sensors and/or close the valve upon detecting a leak or rupture.

Another need exists for an improved automatic shutoff valve which can be economically produced and adapted for use in a number of environments.

Accordingly, an automatic shutoff valve is provided. The valve is preferably constructed of a check valve portion and a shutoff valve portion. The check valve is normally closed in a no-flow configuration. Upon initiation of flow (even a drip leak), the check valve unseats and provides and assists in providing a pressure differential across a piston in the shutoff valve portion. The amount of pressure differential and the length of time exposed to the pressure differential determine the speed at which the piston moves to the shut position. As long as the pressure differential stops before the piston closes, the shutoff valve resets to the fully open position. However, if the shutoff valve shuts, it preferably must be manually reset.

The energy necessary to drive the piston can be made to be about 1 psi, or more or less in other embodiments. The check valve is preferably dampened when closing and fills a reservoir which feeds into the shutoff valve. A reset path, a discharge valve, and a release member allow for the manual resetting of a closed shutoff valve as well as for the automatic reset of the shutoff valve when the shutoff valve does not close during normal operation.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWING

Figure 6:
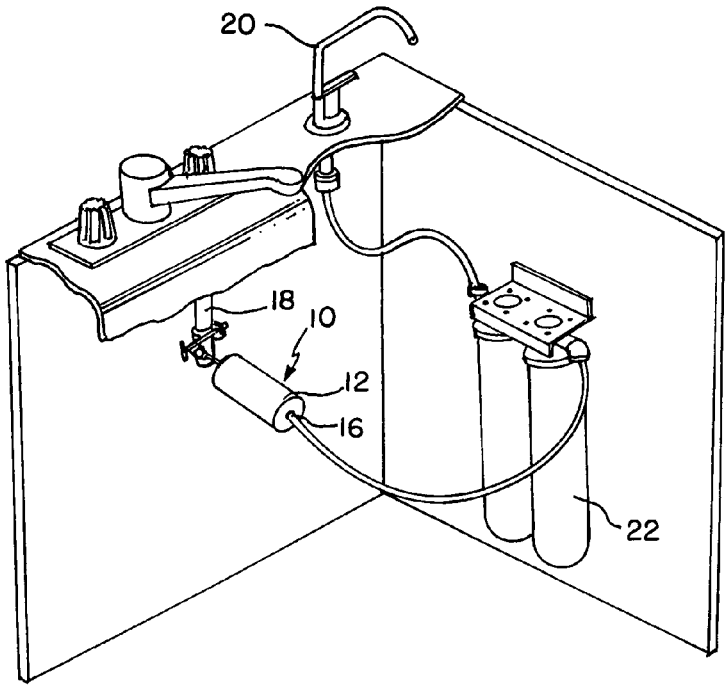
FIG. 6 is a perspective view of a proposed installation of the preferred embodiment shown in FIG. 1.
Figure 7:
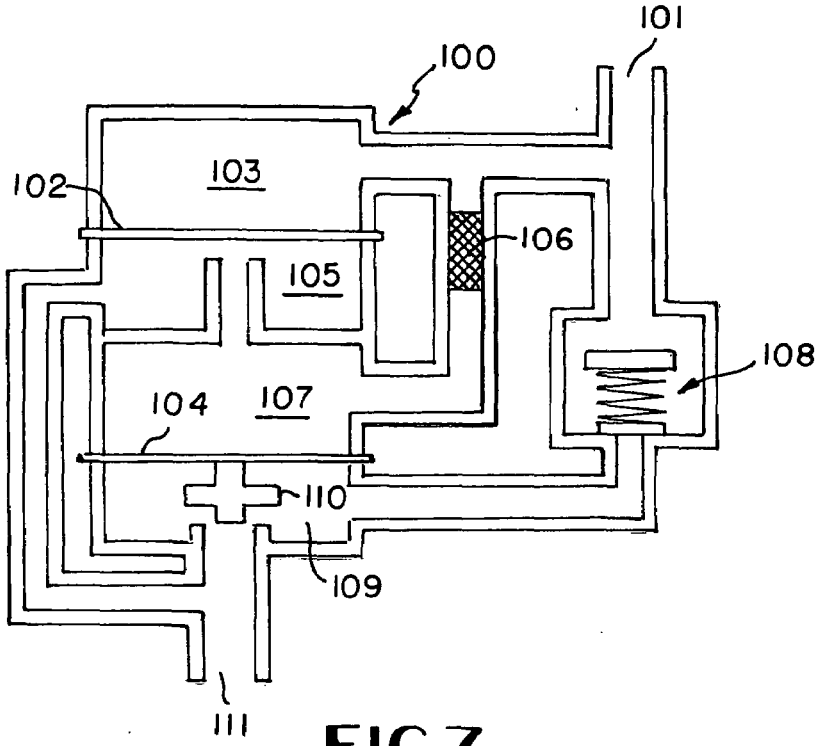
FIG. 7 is a schematic view of a first alternative embodiment of an automatic shutoff valve.
Figure 8:
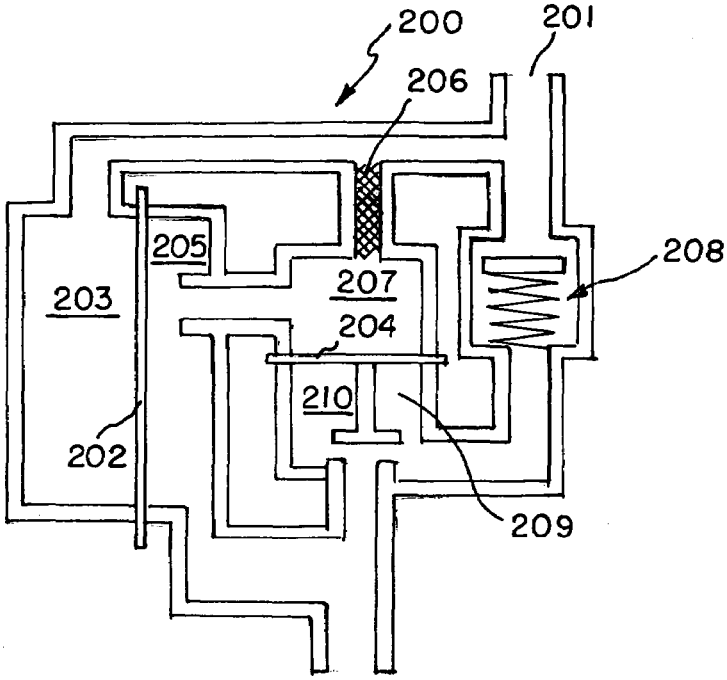
FIG. 8 is a schematic view of a second alternative embodiment of an automatic shutoff valve.

FIGS. 1–6 relate to the presently preferred embodiment of an automatic shutoff valve ("ASOV") 10 in accordance with the presently preferred embodiment of the present invention. FIGS. 7 and 8 relate to alternatively preferred embodiments. Other embodiments may also become apparent through the teachings disclosed herein. The ASOV 10 can be utilized in any fluid system, whether they involve water or other fluids. Although use is described in connection with water systems below, it will be understood by one skilled in the art that other fluid systems are also applicable.

The ASOV 10 is preferably contained in a housing 12. The housing 12 can take may forms but preferably provides an container having an inlet 14 and an outlet 16. The inlet 14 may be connected to a water source 18 such as the water supply in a residential setting as shown in FIG. 6, or to any other water source such as in a commercial environment or otherwise. The outlet 16 is preferably directed to at least one, a possibly a plurality of fixtures and/or appliances such as the faucet 20 supplied by filters 22 illustrated. Other fixtures and appliances could include icemakers, water dispensers, water filter systems, dishwashers, washing machines, auto fill coffee brewers, some water coolers, toilets, and any other fixture and/or appliance that one would prefer dispenses less than a predetermined amount upon any particular use. Additionally, multiple fixtures and appliances may be located downstream of a single ASOV 10 in some embodiments.

In the example shown in FIG. 6, if one of the filters 22 were not correctly installed, a leak could develop. In the absence of the ASOV 10, the water could drip in the space illustrated and potentially cause problems, especially if the leak is significant and/or goes undetected for a period of time. While the ASOV 10 is shown as a separate component in the preferred embodiment, it could be manufactured as a part of an appliance or fixture as well such as within a dishwasher, etc.

Figure 3:
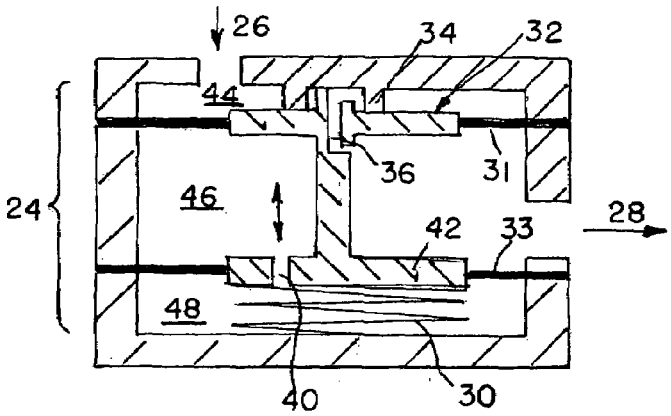
FIG. 3 is a schematic view of the shutoff valve portion of the automatic shutoff valve shown in FIG. 1 in a shut configuration.
Figure 5:
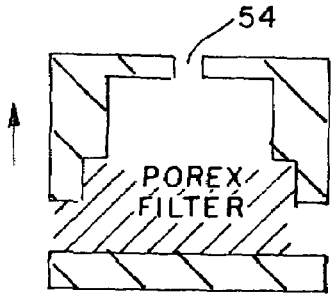
FIG. 5 is an enlarged view of a restrictor/filter combination utilized in the preferred embodiment shown in FIG. 1.

The ASOV 10 is comprised of several portions in the preferred embodiment. FIG. 3 shows a schematic representation of a check valve portion 24. In FIG. 3, the check valve portion 24 in the housing 12 has a check valve which is in the closed configuration in a static and/or no flow condition. Water enters from upstream through check valve inlet 26. In normal operation the ASOV 10 is in a standby configuration. The water pressure at the check valve inlet 26 and check valve outlet 28 (downstream) are equal when there is no flow through from the outlet 16. Accordingly, one or more bias members such as spring 30 and diaphragms 31,33 can be utilized to locate seat 32 against seal 34 to prevent flow through the check valve portion out the check valve outlet 28. Furthermore, a higher pressure at the check valve outlet 28 than at the check valve inlet 26 will also seat the check valve as illustrated in FIG. 3 (i.e., it prevents reverse flow through the check valve portion 24, and thus through the ASOV 10 in the preferred embodiment.

Should a drip leak, a rupture, or a demand for up to, or exceeding, a predetermined amount of water occur at the outlet 16, the pressure at the check valve outlet 28 will drop below the pressure at the check valve inlet 26. This will cause the check valve seat 32 to move away from the seal 34 as illustrated in FIG. 1 into an open configuration.

Figure 1:
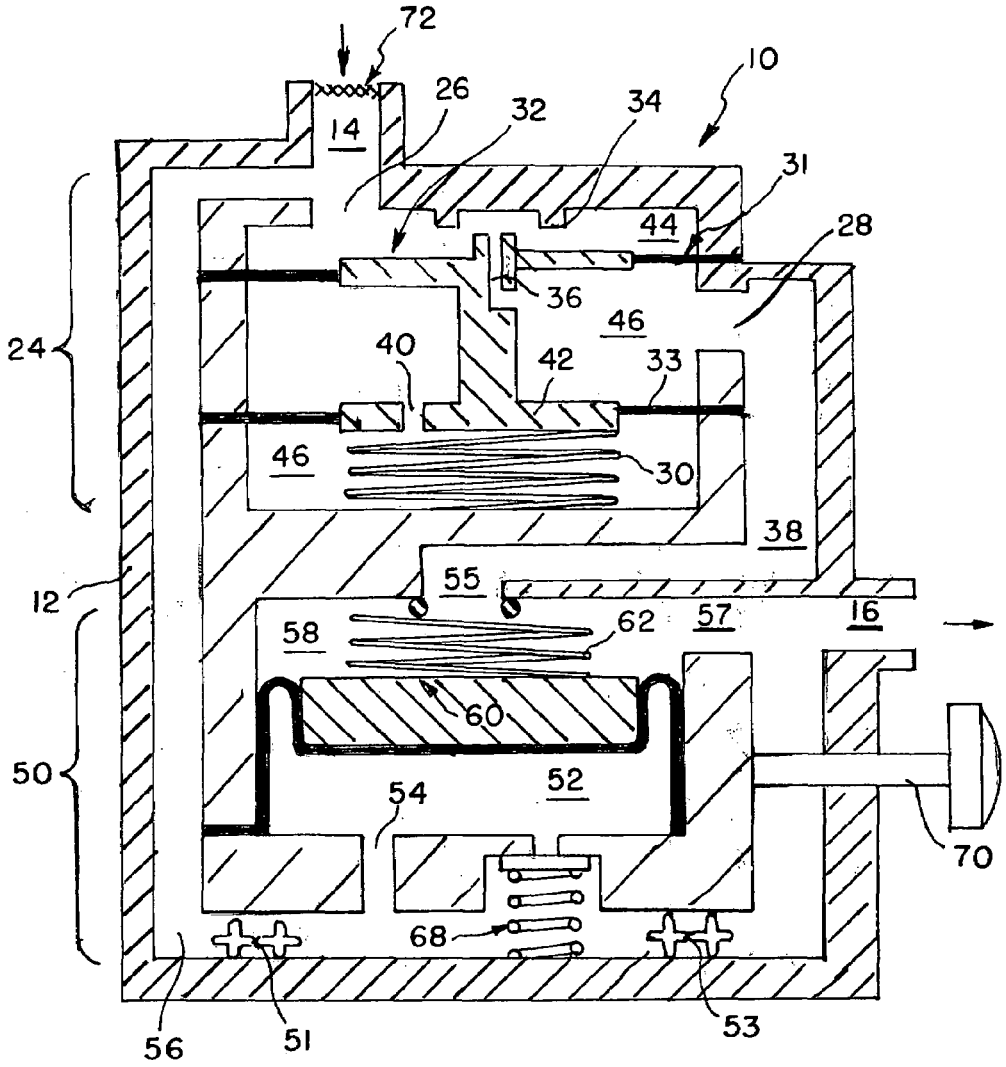
FIG. 1 is a schematic view of an automatic shutoff valve in accordance with the presently preferred embodiment of the present invention in an initially open configuration.

As shown in FIG. 1, as water flows in inlet 14 and into check valve inlet 26, it then proceeds past seat and seal 32,34 into passage 36. The passage 36 is preferably sized so that upon pressure equalization across the check valve inlets and outlets 26,28, the accumulator 38 refills before the seat and seal 32,34 contact to shut the check valve portion 24 as shown in FIG. 3. A damper illustrated as a bore 40 through disc 42 has been found helpful to slow the movement of the check valve portion 24 intermediate an open configuration as shown in FIG. 1 and the closed configuration shown in FIG. 3.

The check valve portion 24 has three chambers, the first chamber 44 which is in fluid communication with the inlet 26, the second chamber 46 which is in fluid communication with the accumulator or reservoir 38, and the third chamber 48. In the open configuration shown in FIG. 1, the first and second chambers 44,46 are in fluid communication with one another allowing water to pass from the check valve inlet 26 out the check valve outlet 28. The second and third chambers 46,48 are in communication through the bore 42. The size of the bore 42 and the force of the bias members are believed to affect the rate of dampening.

As the pressure differential across the check valve portion 24 increases, more flow passes through passage 36. The bias of the biasing members is overcome and water passes through the bore 42 from the third to the second chambers 48,46. When the pressure equalizes, such as if someone secures flow from the appliance(s) and or fixture(s) downstream, as long as the shutoff valve portion 50 has not shut, the check valve will start back to the shut configuration shown in FIG. 3. However, water must pass through the bore 42 from the second to the third chamber 46,48 in order for the seat 32 to contact the seal 34. Accordingly a dampening action occurs with the closing of the check valve portion 24.

Figure 4:
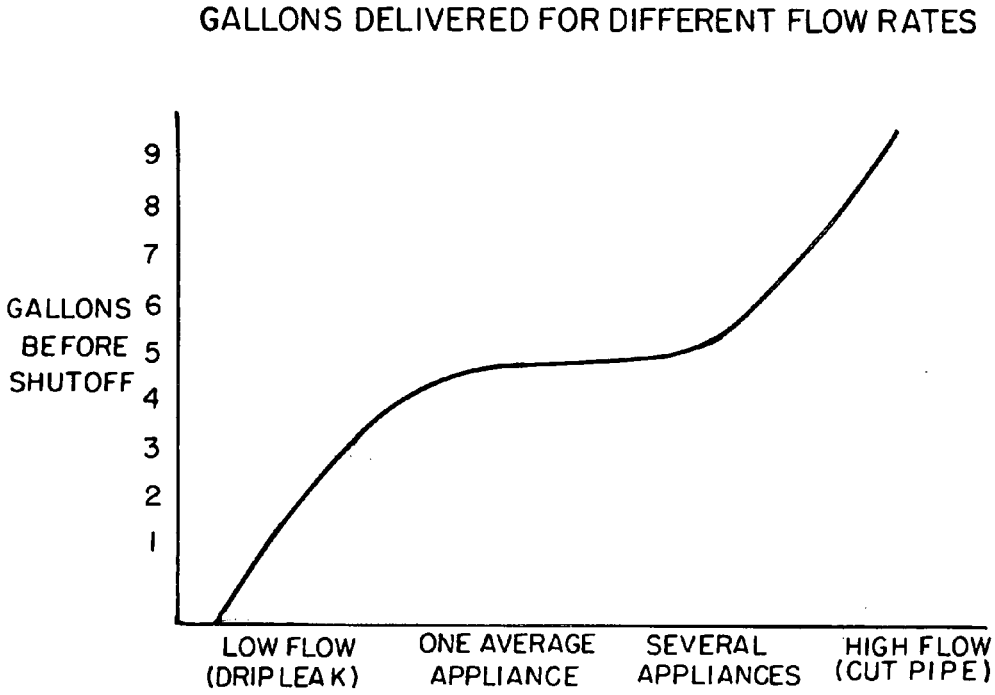
FIG. 4 is a chart showing the volume of water dispensed before the automatic shutoff valve of FIG. 1 shuts under various circumstances.

Water flowing out the check valve outlet 28 or from the reservoir 38 passes through shutoff valve portion 50 during a flow condition out outlet 16 (such as a leak, a rupture, normal operation, etc.). The reservoir 38 and shutoff valve portion 50 are preferably located with the check valve portion 24 in the housing 12. The pressure differential and the rate of flow from the reservoir 38 to the outlet 16 affect the amount of water dispensed from the ASOV 10 before the shutoff valve portion 50 shuts. FIG. 4 shows a flow curve of this affect and will be described in further detail below.

In FIG. 1, the shutoff valve portion 50 is in an open configuration, i.e., a first position. Water from the reservoir 38 is in communication with the outlet 16 and any demand from the outlet, such as a drip leak, rupture, or normal use will create a pressure differential at the outlet 16 relative to the inlet 14. Water at the inlet 14 is preferably in direct communication with a first chamber 52 in the shutoff valve portion 50 through bypass line 56. Water passes through a restrictor, such as an orifice 54 illustrated, which communicates first chamber 52 with bypass line 56 and inlet 14. In the event of a pressure differential, the pressure at the inlet 14 and thus in the bypass line 56 will be greater than at the outlet 16 which is in communication with second chamber 58. This causes a shutoff actuator, such as the piston 60 illustrated, to overcome the bias of bias member 62, if utilized, and proceed toward piston seal 64. Shutoff actuators, such as a diaphragm 66, and/or piston 60, and/or other appropriate member prevent fluid communication intermediate the first and second chambers 52,58.

The bias member may assist or hamper movement of the piston 60 toward the piston seal 62 depending upon the design criteria of the ASOV 10. Nevertheless, in the event the pressure is greater in the first chamber 52 than in the second chamber 58, the piston 60 preferably moves toward the piston seat 62. During normal flow requirements, i.e., which are when less than a predetermined amount of fluid flows, the flow from the outlet 16 stops before the predetermined amount of flow has been achieved. The pressure in the first and second chambers 52,58 are now equal and the force of the bias member 62 is useful in returning the piston 60 to its fully open position. Instead of requiring all of the water to be pushed from the first chamber 52 out the orifice into the bypass line 56, discharge valve 68 is useful. Discharge valve is a normally closed check valve that opens when the pressure in the first chamber 52 exceeds the pressure in the bypass line 56. In the preferred ASOV 10, this allows extremely rapid resetting of the ASOV 10.

The shutoff valve portion 50 has a shutoff valve portion inlet 55 and a shutoff valve portion outlet 57 which in the preferred embodiment. The shutoff valve portion inlet 55 is in communication with the reservoir 38 and the shutoff valve portion outlet 57 is in communication with the outlet 16. The piston, when in the second position, with the piston in contact with the piston seal 64, secures the flow from the shutoff valve portion inlet 55, and thus the reservoir 38, to the shutoff valve portion outlet 57, and thus the outlet 16. When the shutoff valve portion 50 is not in the second position, then flow can proceed from the reservoir 38, and thus through the shutoff valve portion inlet 55 to the shutoff valve portion outlet 57 and outlet 16.

Figure 2:
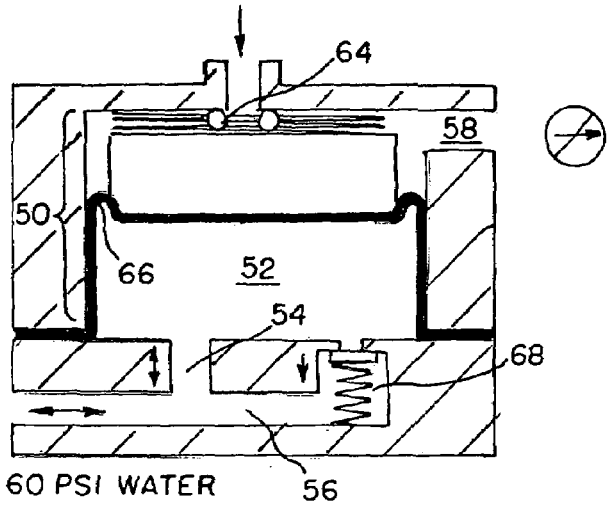
FIG. 2 is a schematic view of the check valve portion of the automatic shutoff valve shown in FIG. 1 in a shut configuration.

FIG. 2 shows the shutoff valve when one of the following conditions have occurred (1) a drip leak has been identified, (2) a rupture has occurred, or (3) more than the predetermined amount of fluid has been dispensed. The pressure at the inlet 14 and thus in the first chamber 52 exceeds the pressure at outlet 16, and apparently has maintained this condition long enough to shut the shutoff valve portion 50, i.e., place it in the second position. Once in this configuration, the ASOV 10 has performed its designed function, the leak is stopped, the rupture secured, or the fixture/appliance device(s) have exceeded their predetermined demand amount for water.

FIG. 1 also shows optional fluidly impervious moveable members 51,53 which allow for a fluid of a known quality to pass through the restrictor illustrated as orifice 54. Although moveable members 51,53 are not utilized in the presently preferred embodiment, they can be utilized when a selected fluid such as purified (i.e., filtered) mineral oil is utilized to pass through the orifice 54. This modification has been found to reduce the possibility of clogging of the restrictor or orifice 54 over time. A filter, such as the one illustrated in FIG. 5 may, or may not, be utilized in this embodiment. The moveable members 51,53 allow the pressure on either side of the moveable members 51,53 to be equal while preventing leakage past the moveable members 51,53. Hence, as the first chamber 52 fills in FIG. 1, the first moveable member 51 moves toward the orifice 54. Although pistons are illustrated as the moveable members 51,53, diaphragms or other appropriate structures could be utilized in other embodiments.

Once the faulty condition has been addressed, the ASOV 10 may be reset. Upon activation of the reset member 70, in this case pulling the member to communicate the bypass line 56 with the outlet 14, water can then flow and/or equalize pressure from the bypass line 56 to the outlet 16. Since the bypass line 56 is in direct communication with the inlet 14, this equalizes pressure in the first and second chambers 58,60, and the bias member 62 can assist in dislodging the piston 60 from the piston seat 64 as the shutoff valve portion 50 returns to the open configuration shown in FIG. 1. The reset member 70 is then returned to the position shown in FIG. 1.

FIG. 4 shows the various closing events which can trigger the ASOV 10 shutting. In a drip leak situation the pressure differential from the inlet 14 to the outlet 16 may be small, nevertheless only a small amount of water flows out of the outlet 16 due to the demand of the drip leak. However, the orifice 54 may not significantly limit the speed of travel of the piston 60 toward the piston seat 62 during this event. Thus, only a first and small volume of liquid is dispensed before the shutoff valve portion reaches the position shown in FIG. 2.

When one appliance or fixture is connected to the outlet 16, a normal flow rate such as 0.25 to 1 gallons per minute may be established from the outlet 16 (of course other flow rates could be provided for in other embodiments), the check valve unseats relatively quickly and is provided to a fully open position as shown in FIG. 1. Water passes from the inlet 14 through the check valve portion 24 into the reservoir 38, through the second chamber 58 of the shutoff valve portion 50 and out the outlet 14. Meanwhile the orifice 54 restrict flow from the bypass line 56 into the first chamber 52 thereby controlling the movement of the piston 60 toward the piston seat 62. If the predetermined amount is exceeded, in this example, being around four gallons, the ASOV 10 shuts as described above. A second volume, greater than the first volume dispensed in a drip leak, is dispensed from outlet 16.

If a rupture were to occur, the flow through the check valve portion 24 and reservoir would be higher than expected. The passage 36 can be sized to limit the damage done in such an event. The orifice 54 will still restrict the flow into the first chamber 52, however the pressure differential will be greater in such an event. Nevertheless, the ASOV 10 construction still exhibits excellent protection capability. FIG. 4 just shows the presently preferred embodiment. The volume of the reservoir 38, the sizing of the passage 36, and the orifice 54 can dramatically affect the performance. In fact, the orifice 54 may be an adjustable needle valve and the purchaser could adjust the predetermined amount to which the flow should not exceed in a single cycle (such as if several appliances are subsequently connected downstream of the outlet 16).

Although not shown very well in the diagrams of FIGS. 1–4, it is anticipated that the orifice 54 will have a Porex™ or other appropriate filter 72 located on the inlet side of the orifice 54 to prevent debris in the water supply from clogging the orifice. The Porex™ filter construction has been found to be advantageous since flow about the outside of the filter 72 also serves to provide a self-cleaning function. Flow occurs about the outside of the filter 72 in the preferred embodiment since the bypass line 56 portion illustrated is normally in the flow path from the inlet to the passage 36, although not illustrated in FIGS. 1–3. Another feature of the Porex™ filter is that it is one way. Flow exiting the first chamber 52 of the shutoff valve portion 50 must exit via the discharge valve 68. A filter can also be installed in the bore 40 of the check valve portion as well as in the passage 36. The filters can be utilized to control flow rates in addition to preventing clogging by debris in the water supply.

The reset member 70 is preferably spring biased in its normal position as illustrated in FIG. 1. Many of the internal parts may be molded, such as the piston 60 and much of the check valve portion 24. An inlet screen 72 is also useful to prevent harmful debris from entering the inlet 14. Seals 34, 64 can be o-rings or other appropriate members. An o-ring may also be useful to prevent water flowing past the reset member 70 out of the housing 12.

The preferred embodiment ASOV 10 is configured to detect leaks, even if small.

The shutoff valve section 50 is preferably constructed so that it leaks less than 1 oz of water per day when closed under about 20 psi to about 100 psi water supply pressure. It is preferred that it restrict water flow to a negligible degree when in normal operation (i.e., flow up to but less than the predetermined amount under normal demand conditions from the outlet 16). The shutoff valve portion 50 can be reset with the reset mechanism 70 once in the second or shut position. It is further possible to reset the shutoff valve portion 50 be reducing water pressure on the upstream side, such as by removing the water pressure from the upstream and downstream sides.

The ASOV 10 of the preferred embodiment is preferably activated by about a 1 psi or greater pressure differential (common in drip flow scenarios). Of course, tighter tolerances could be achieved in other embodiments. Water pressures of up to about 100 psi are common across the United States, and the ASOV 10 preferably can accommodate all such expected water pressures. When operating upon an expected demand, the pressure drop from the inlet 14 to the outlet 16 is preferably intermediate 1 and 10 psi.

The ASOV 10 preferably distinguishes between normal and undesirable water usage. This is believed to require more than instantaneous flow rates. Flow rates follow certain time related patterns to be classified as normal flow rates. Flow rates that do not fall within the normal patterns preferably cause the ASOV 10 to shut. The normal patterns cause a storage volume (which is preferably replenished at least partially during the process, and probably several times) to charge and then discharge before the valve shuts. Reaching a critical volume of flow dispensed in a particular time causes the valve to shut.

The ASOV is designed to reset automatically as long as it does not shut. This occurs very rapidly in the preferred construction, such is in about a second. The bias member 62 and discharge valve 68 assist in this feature. This allows the ASOV 10 to dispense water repeatedly, with normal flow patterns, without closing the valve.

The check valve portion 24 can be utilized to provide several functions. It prevents reverse flow through the ASOV 10. Reverse flow cannot pass through the bypass line 56 during normal operation since the release member 70 normally prevents communication intermediate the outlet 16 and the bypass line 56.

The check valve portion 24 also provides a pressure differential to provide energy to operate the ASOV 10. Additionally, it reduces the pressure drop to approximately zero during reset phase of normal operation. For some check valve portion constructions, the check valve portion 24 can exhibit an over-center type action due to hysteresis in the flow versus position curve of the valve. It can take a flow rate within or above the normal flow rate to move the check valve portion 24 to its fully open position. It can also take a flow of well less than the normal flow rate to allow the check valve portion to return to its normally closed position (a no flow condition). During the return of the check valve portion 24 from its fully open to fully closed positions, the pressure drop across the check valve is reduced sufficiently to allow the reservoir 38, or storage volume to reset. A dampener mechanism is preferably utilized to slow the motion of the check valve so that the low pressure drop is sustained long enough for the storage volume to discharge.

In the preferred embodiment the main check valve portion 24 accomplishes at least some if not all of four actions: (1) for flows less than the normal operating range, provide a small fixed pressure drop without arming for the reset function; (2) for flows in or above the normal operating range, provide a variable pressure drop based on flow rate and arm for the reset function; (3) if the reset function has not been armed, then when flow reduces or stops maintain the pressure drops; and (4) if the reset function has been armed, then when flow reduces below the minimum holding flow provide the reset function.

The reset cycle of the check valve portion 24 may have hysteresis and it motion may be slowed by a damper. When the flow has reduced to the point that the flow no longer maintains the valve open, the check valve starts moving toward close but the motion is preferably slowed by a damper. The check valve preferably moves through a position that reduces a pressure drop due to the construction of the check valve portion and/or the housing. While the check valve is in the reduced pressure drop position (such as occurs through the passage 36 during reset), the storage volume can be reset. The damper assists in resetting the reservoir 38. The shutoff valve portion 50 is now fully open, with the storage volume reset and the reset cycle is complete. Although a check valve portion 24 is utilized in the preferred embodiment, a restrictor, regulator or other device may be utilized in other embodiments to create a pressure differential across the shutoff valve portion 50.

FIGS. 7 and 8 relate to two alternatively preferred embodiments. These designs relate to early prototypes which function with similar components. These valves operate by crating a pressure differential as water flows through a check valve, restrictor, regulator or other device as well. The pressure differential is utilized to add volume to a chamber with a flexible diaphragm that moves toward a cutoff mechanism that activates after a set amount of water has been dispensed from the ASOV. Functionally this is similar to what occurs in the preferred embodiment ASOV 10.

The cutoff mechanism can be a mechanical shutoff that activates when the diaphragm reaches a set point. The cutoff valve may be located before or after other components in the ASOV. A restrictor may be utilized to control the rate at which the diaphragm chamber is filled or reduced. By utilizing the volume created by a pressure differential based on flow, much lower flows may be detected than with devices that utilize turbines, vanes or impellers.

An ASOV ma also be designed that would bleed down with flow instead of building pressure with a diaphragm and cutoff mechanism. In this device the volume in the diaphragm chamber would reduce with flow and activate the cutoff mechanism after a set amount of water has been dispensed. A restrictor may be used to control the rate of flow into or out of the diaphragm chamber.

Normal flow patterns and undesirable flow patterns typically differ in that normal flow patterns transition from within or above the normal flow rate to well below the normal flow range before the storage volume (reservoir 38) charges to a critical threshold (below the predetermined amount). The storage volume is preferably big enough to allow all normal flow volumes to be dispensed without reaching the critical threshold. It is preferably not so large that excessive amounts of undesirable flow occur. The storage volume may be configured so that it charges slowly, but discharges quickly so that it can be reset quickly when the main check valve provides low pressure drop. The storage volume is also not in contact with outside air pressure thus insuring that it is not susceptible to upstream water supply pressure variations. The storage volume may also be at least partially refillable during operation, as shown in the preferred embodiment.

In either case, once water has stopped from the dispensing action, the diaphragm resets itself to the original (neutral) position to be available for the next dispensing action. The diaphragm may or may not reset itself if the cutoff mechanism has been activated, depending on whether they are combined into the same mechanism or as separate independently operating components. To reset the diaphragm a slow closing check valve may be used that will allow water pressure on both sides of the diaphragm to equalize the volumes and return the diaphragm to its neutral position. A momentary valve may be used to allow the volumes on both sides of the diaphragm to equalize when the dispensing action stops. A return spring may be used on one or both sides of the diaphragm to assist it back into its neutral position.

In reference to the alternative embodiments of FIGS. 7 and 8, which are function similar to the preferred embodiment in many respects, there are seven operating states. The first state is static. There is no water flowing through the connected water line or the ASOV such as ASOV's 100 or 200 of FIGS. 7 and 8. The diaphragm 102, 202 are in the neutral position (not shut). Flow rates within the normal operating range are flow rates that are normal to the operation of the down stream devices such as filter systems (shown in FIG. 6), Point of Use (POU) water coolers, icemaker, etc. which generally have flow rates intermediate about 0.5 gpm to 1.0 gpm.

The second operating state is flow under normal operating conditions (in the normal operating range). Flow rates below the normal operating levels, such as very slow drip leaks do not flow enough to open the flow valve. Water is pulled directly from a diaphragm chamber which activates the cutoff valve after a small volume of water has flowed.

The third operating state is flow within the normal operating range. The flow valve opens, water is dispensed, and the water volume in the diaphragm chamber builds.

The fourth operating state is flow above the normal operating range. A flow regulator may be used to regulate the maximum flow rate and to provide additional pressure differential which will activate the cutoff valve after a lower amount of water has been dispensed.

The fifth operating state is an amount dispensed under the cutoff level. If the amount of water dispensed is less than the amount required to activate the cutoff valve, when flow stops, the diaphragm returns to its neutral position.

The sixth operating state is an amount dispensed to the cutoff level (i.e., the shutoff valve is activated). When the diaphragm moves to a set point, a mechanical shutoff valve is activated that stops all flow.

Finally, the seventh operating state is resetting the ASOV. To reset the valve, a user presses a button that resets the mechanical valve to its open position.

At different flow rates, different amounts can be dispensed from the ASOVs 100,200. The flow rate through a filter system during a dispensing action can have maximum predetermined flow (a maximum normal usage), such as 2.0 gallons at one dispensing action.

Very low flow leaks are designed to activate the shutoff valve before the normal dispensing cutoff level has been reached. Additionally, it would be advantageous to activate the shutoff valve early if the flow rate is well above the normal flow rate, which could be caused by large leaks in the downstream line or devices. Adding a flow regulator that provides additional restriction above the desired flow rate will increase the pressure differential to the diaphragm and activate the cutoff valve at a lower dispensing amount.

Dispensing amounts for different water treatment and dispensing devices may have different amounts of water needed to be dispensed in one action. An adjustable amount of water that can be dispensed in one action may be desirable in some embodiments. A variable restrictor that the user can adjust that allows the rate of flow into or out of the diaphragm chamber is one way to modify the amount of water that the ASOV dispenses before cutoff.

A sediment strainer which may be a screen mesh, spiral wound, sintered metal, porous plastic, etc can be used to provide protection to sealing mechanisms like check valves, restrictions, etc. against sediment particles impeding proper function.

While the ASOV may be located at the source of the plumbed in water line of the dispensing device such as a water filter system, a useful feature of slowing the flow of water coming out of the dispenser just before the cutoff valve is activate to let the user know that water flow cutoff is imminent may be implemented in some embodiments. This can allow the user to momentarily stop the dispensing action to let the ASOV reset. Dispensing can then be resumed again.

Full open flow that occurs when a downstream water line has been severed may activate the cutoff valve immediately to reduce the amount of water dispensed. Any flow above a present flow rate can be utilized to activate the cutoff valve.

A double diaphragm can also be utilized in some embodiments. A device with two diaphragms may be incorporated which has a first diaphragm that is exposed to upstream pressure, on the other side and between a second diaphragm is a first chamber and a second chamber. An interior wall located between the two chambers may have a restrictor, which can be variable in sized or fixed. A check valve can also allow flow back from the second chamber to the first chamber. The second diaphragm is exposed on its outside to downstream pressure. The first and second chambers may be filled with a mineral oil or other fluid that can flow through the restrictor and check valve without clogging. By using mineral oil, or other non-clogging fluid, the restrictor may be small and since the fluid is contained between the two diaphragms, there would be a small likelihood that the restrictor could become clogged over time. The check valve may allow the diaphragms to return to their neutral positions after a dispensing action.

A check valve to allow water to backflow through the device may be used in some embodiments to prevent water pressure on the downstream side to build up do to temperature and other factors.

Referring now to FIGS. 7 and 8. Check valves 108 and 208 are check valves, and preferably 1 psi crack check valves. When water flows from inlets 101,201 to outlets 111,211 due to a leak or an appliance using water, the pressure at outlet 111,211 is lower than at inlet 101,201, respectively. Whenever no water is flowing, the pressures are the same (i.e., zero pressure differential). When high flow rates occur, the pressure differential can be greater, such as up to or exceeding 10 psi.

As soon as the pressure at the outlet 111,211 is lower than the pressure at the inlet 101,201, water flows into chamber 103,203 from inlet 101,201, the first diaphragm 102,202 flexes downwardly (or sideways). The water in chamber 105,205 exits to outlet 111,211, and the diaphragm seals and isolates chamber 105,205 from chamber 107,207. When the seal is closed the reset water path from 107,207 through 105,205 through 111,211 to 109,209 is closed. The result is that whenever there is flow through the check valve, the reset water paths are closed.

When water is flowing through the check valve 108,208, the reset path is closed and restrictor 106,206 provides a slow water flow into chamber 107,207 which is now sealed off. This causes the second diaphragm 104,204 to bow downward slowly into chamber 109,209 which is at the downstream pressure (1 psi or more lower than the upstream pressure 20 to 200 psi).

When the second diaphragm bows sufficiently, the valve stem 110,210 closes the device and no more water flows. Since the first diaphragm 102,202 sees 20 psi or more upstream and now 0 psi downstream, it stays pressed downward sealing the reset path. This keeps the device closed as long as the downstream pressure is low.

If the leak or water usage stops before the valve 110,210 closes, then the downstream pressure equalizes to the upstream pressure. First diaphragm 102,202 no longer sees a pressure difference and relaxes away from the seal and opens the seal. This allows water to flow from chamber 107,207 through 105,205 and around to chamber 109,209. This lets the second diaphragm 104,204 relax and opens valve 110,210. This would be an automatic reset. The valve can be designed to lock closed when it closes and require manual intervention to open it again. This device can function with either a manual or an automatic reset.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. An automatic shutoff valve comprising:

a housing having an inlet, an outlet, and a reservoir;

a check valve portion located in the housing and in communication with the inlet on an upstream side of the check valve portion and the reservoir on an downstream side of the check valve portion, said check valve portion preventing flow from the inlet to the reservoir in the absence of a pressure differential across the check valve portion in a shut configuration, said check valve portion having an open configuration allowing flow from the inlet to the reservoir when fluid pressure upstream of the check valve portion exceeds pressure downstream of the check valve portion by a first predetermined amount and said check valve preventing flow from the outlet to the inlet when in the shut configuration; and a shutoff valve portion in the housing having a first chamber in pressure communication with the inlet and a second chamber in fluid communication with the reservoir and the outlet in a first position, said first and second chamber separated by a shutoff actuator, said shutoff actuator moveable from the first position to a second position wherein when in the second position the shutoff actuator prevents fluid communication from the reservoir to the outlet, and a higher pressure at the inlet than at the outlet provides increased pressure in the first chamber relative to the second chamber thereby moving the shutoff actuator from the first position toward the second position, and wherein flow from the reservoir passes through second chamber prior to proceeding out of the outlet.

2. The automatic shutoff valve of claim 1 wherein the check valve portion prevents flow from the outlet to the inlet should the pressure at the outlet exceed the pressure at the inlet.

3. An automatic shutoff valve comprising:

a housing having an inlet, an outlet, and a reservoir;

a check valve portion located in the housing and in communication with the inlet on an upstream side of the check valve portion and the reservoir on an downstream side of the check valve portion, said check valve portion having an open configuration allowing flow from the inlet to the reservoir when fluid pressure upstream of the check valve portion exceeds pressure downstream of the check valve portion by a first predetermined amount; and a shutoff valve portion in the housing having a first chamber in pressure communication with the inlet and a second chamber in fluid communication with the reservoir and the outlet in a first position, said first and second chamber separated by a shutoff actuator, said shutoff actuator moveable from the first position to a second position wherein when in the second position the shutoff actuator prevents fluid communication from the reservoir to the outlet, and a higher pressure at the inlet than at the outlet provides increased pressure in the first chamber relative to the second chamber thereby moving the shutoff actuator from the first position toward the second position, and wherein the check valve portion further comprises a dampener, said dampener retarding the return of the check valve portion from an open to a shut configuration.

4. The automatic shutoff valve of claim 1 wherein the check valve portion exhibits hysteresis.

5. The automatic shutoff valve of claim 1 wherein the first chamber of the shutoff valve is supplied by fluid flow through a filtered restrictor.

6. The automatic shutoff valve of claim 5 wherein the restrictor has a filter disposed therein.

7. The automatic shutoff valve of claim 6 wherein flow from the inlet to the reservoir cleans an outer surface portion of the filter.

8. The automatic shutoff valve of claim 5 wherein the restrictor provides a predetermined flow.

9. The automatic shutoff valve of claim 5 further comprising a selected fluid not in fluid communication with the inlet or outlet, said selected fluid contained within the first chamber and retained by at least one moveable member opposite the restrictor from the first chamber, said moveable member communicating the pressure from the inlet to the restrictor through the moveable member.

10. An automatic shutoff valve comprising:

a housing having an inlet, an outlet, and a reservoir;

a check valve portion located in the housing and in communication with the inlet on an upstream side of the check valve portion and the reservoir on an downstream side of the check valve portion, said check valve portion having an open configuration allowing flow from the inlet to the reservoir when fluid pressure upstream of the check valve portion exceeds pressure downstream of the check valve portion by a first predetermined amount; and a shutoff valve portion in the housing having a first chamber in pressure communication with the inlet and a second chamber in fluid communication with the reservoir and the outlet in a first position, said first and second chamber separated by a shutoff actuator, said shutoff actuator moveable from the first position to a second position wherein when in the second position the shutoff actuator prevents fluid communication from the reservoir to the outlet, and a higher pressure at the inlet than at the outlet provides increased pressure in the first chamber relative to the second chamber thereby moving the shutoff actuator from the first position toward the second position, and a biasing member directing the shutoff actuator toward the second position, wherein upon equalization of pressure at the inlet and outlet, the biasing member returns the shutoff actuator to the first position, a discharge valve providing one-way flow communicating the first chamber with the inlet, and when the shutoff actuator returns from a position toward the second position toward the first position, at least some fluid in the first chamber is expelled through the discharge valve.

11. The automatic shutoff valve of claim 1 further comprising a release member, and upon actuation of the release member, equalizing pressure between the outlet and the reservoir.

12. The automatic shutoff valve of claim 1 wherein the first chamber is in fluid communication with the inlet.

13. The automatic shutoff valve of claim 1 wherein the shutoff valve portion reaches the second position under normal flow conditions after a first predetermined amount of flow passes through the outlet.

14. The automatic shutoff valve of claim 13 wherein the shutoff valve reaches the second position under a less than normal flow condition after a second predetermined amount of flow passes through the outlet, said second predetermined amount of flow less than the first predetermined amount of flow.

15. An automatic shutoff valve comprising:

a housing having an inlet, an outlet and a reservoir, said inlet at least selectively in fluid communication with the reservoir;

a shutoff valve portion having a shutoff valve portion inlet in fluid communication with the reservoir, and a shutoff valve portion outlet in fluid communication with the outlet, said shutoff valve portion having a first chamber in pressure communication with the inlet, said shutoff valve portion having a piston driven by a relative pressure differential between the first chamber and the outlet, said piston having a first position allowing fluid communication from the shutoff valve portion inlet to the shutoff valve portion outlet and a second position securing whereby the piston prevents fluid communication from the shutoff valve portion inlet to the shutoff valve portion outlet; and a restrictor filtering and restricting a flow of fluid into the first chamber.

16. The automatic shutoff valve of claim 15 further comprising a check valve intermediate the inlet and the reservoir in the housing said check valve preventing flow from the outlet to the inlet when in a shut configuration.

17. The automatic shutoff valve of claim 16 wherein the check valve normally isolates the inlet from the reservoir in a no-flow condition, and the check valve opens at least partially to allow flow from the inlet to the reservoir upon experiencing a predetermined pressure differential across the check valve.

18. The automatic shutoff valve of claim 15 wherein said flow from the outlet to the inlet is prevented by a check valve in the housing.

19. An automatic shutoff valve comprising a housing having an inlet an outlet and a reservoir, said inlet at least selectively in fluid communication with the reservoir;

a shutoff valve portion having a shutoff valve portion inlet in fluid communication with the reservoir, and a shutoff valve portion outlet in fluid communication with the outlet, said shutoff valve portion having a first chamber in pressure communication with the inlet, said shutoff valve portion having a piston driven by a relative pressure differential between the first chamber and the outlet, said piston having a first position allowing fluid communication from the shutoff valve portion inlet to the shutoff valve portion outlet and a second position whereby the piston prevents fluid communication from the shutoff valve portion inlet to the shutoff valve portion outlet; and a restrictor communicating a filtered and restricted flow of fluid into the first chamber; and a first supply of fluid restrained by moveable members about the restrictor, said first supply of fluid not in fluid communication with fluid at the inlet or outlet.

* * * * *